United States Patent [19]

Wright

[11] 4,222,364

[45] Sep. 16, 1980

[54] REAR-LOADING DUAL MODE FURNACE

[76] Inventor: Otis L. Wright, 9511 Telstar Dr., Richmond, Va. 23234

[21] Appl. No.: 9,630

[22] Filed: Feb. 5, 1979

Related U.S. Application Data

[63] Continuation-in-part of Ser. No. 826,910, Aug. 22, 1977, Pat. No. 4,141,335.

[51] Int. Cl.[3] ..... F24H 3/00; F23B 1/12

[52] U.S. Cl. ..... 126/111; 110/173 R; 110/296; 126/190; 126/242

[58] Field of Search ..... 126/2, 3, 242, 190, 126/111; 110/295, 296, 173 R

[56] References Cited

U.S. PATENT DOCUMENTS

| | | | |
|---|---|---|---|
| 660,371 | 10/1900 | Foley | 126/67 |
| 695,840 | 3/1902 | Rose et al. | 126/122 |
| 1,505,407 | 8/1924 | Mork | 126/122 |
| 1,656,326 | 1/1928 | Johnson | 126/123 |
| 2,154,939 | 4/1939 | Howe | 126/123 |
| 2,172,356 | 9/1939 | Brainard | 126/122 |
| 2,283,790 | 5/1942 | Cage | 126/122 |
| 2,453,954 | 11/1948 | Wright | 126/122 |
| 2,471,351 | 5/1949 | Russell | 126/123 |
| 2,578,927 | 12/1951 | Esson | 126/67 |
| 2,791,213 | 5/1957 | Goulding | 126/123 |
| 3,888,231 | 6/1975 | Galluzzo et al. | 126/120 |
| 3,981,291 | 9/1976 | Smith | 126/110 R |
| 3,981,292 | 9/1976 | Lilly et al. | 126/123 |
| 4,141,335 | 2/1979 | Wright | 126/111 |

*Primary Examiner*—James C. Yeung
*Assistant Examiner*—Daniel O'Connor
*Attorney, Agent, or Firm*—Norman B. Rainer

[57] ABSTRACT

A furnace is provided which is capable of heating a circulating current of air by heat produced from the combustion of either solid or fluid fuel. The furnace is constructed with two separate combustion compartments and a surrounding chamber for circulation of the air to be heated. By means of temperature sensor and control means, the fluid fuel supply is stopped when adequate heat is being produced from the solid fuel. The furnace is adapted to heat remotely located rooms by means of conduits which transport air heated within said chamber. The room in which the furnace is located is heated by the front of said furnace by radiation and convectively heated contiguous air. The compartment which combusts solid fuel is provided with a door on the rear of said furnace, thereby permitting wood to be entered into said compartment from outside the room or building in which said furnace is situated. The compartment which combusts fluid fuel is fabricated as an integral unit, facilitating construction and maintenance of said furnace.

9 Claims, 7 Drawing Figures

REAR-LOADING DUAL MODE FURNACE

RELATED APPLICATIONS

This application is a continuation-in-part application of application Ser. No. 826,910, filed Aug. 22, 1977, now U.S. Pat. No. 4141335.

BACKGROUND OF THE INVENTION

This invention relates to an improved furnace useful for heating a building, and is more particularly concerned with a furnace capable of burning both fluid or solid fuels for the purpose of heating air which is circulated to the rooms of a building.

Many residential dwellings are equipped with fireplaces designed for the burning of wood in the form of logs. In such fireplaces, the fire creates an upward draft causing considerable amounts of air to be taken from the building and transported up the flue or chimney and out of the building. The only heat provided by the burning wood is of a radiative nature, and it generally does not compensate for the amount of heat removed from the building in the form of air exhausted through the chimney. Also, whereas the radiative heat will generally affect only the room in which the fireplace is located, the removal of air from the building will cause other rooms to become colder because of the influx of colder air from outside the building. Most such fireplaces are in effect intended primarily as decor, particularly to many who find the burning of logs to be an aethetically pleasing sight.

For actual heating purposes, most residential homes are equipped with specially designed furnaces wherein a liquid fuel such as gas or oil may be continuously and controllably fed to a burner wherein it heats the walls of a combustion compartment. Heat is transferred from the hot outer walls of the compartment to a circulating stream of air which is conducted to the various rooms of the building.

There are numerous disclosures of improved fireplaces wherein heat generated from the burning of wood or coal is caused to heat walls of a chamber which transfers the heat to a circulating stream of air in a manner similar to that employed with oil and gas operated furnaces. Specific examples of such systems may be found in the following U.S. Pat. Nos. 234,921; 695,840; 1,656,326; 2,154,939; 1,505,407; 2,453,954; 2,791,213; 2,172,356; 2,283,790 and 3,981,292.

Although fireplace structures are known having the capability of burning fluid fuels such as gas in addition to wooden logs, the efficiency of utilization of such fluid fuels is generally poor, and no provision is made for the concerted utilization of two different fuels to provide a continuous and controllable amount of heat. In the interest of reducing manufacturing cost and facilitating maintenance, simplification of the construction of such dual mode furnaces is desirable.

Since wooden logs are generally stored outside the building heated by the furnace, the use of wood as a fuel generally necessitates frequent trips outside the building and the carrying of logs through the building. Not only does this admit colder outside air to the building, but it incurrs the risk of introducing into the building insects such as termites which may abound in the log storage area.

It is an object of the present invention to provide a furnace capable of efficiently utilizing either solid or fluid fuel to effect the heating of a stream of air which may be circulated to rooms of a building other than the room containing said furnace. It is another object of the present invention to provide a fireplace furnace of the aforesaid nature capable of utilizing either a solid or fluid fuel in a manner to provide a continuous and controllable amount of heat. It is a further object to provide a furnace of the aforesaid nature which permits viewing of the combustion of solid fuel and has provision for receiving solid fuel from an access port located outside said building. It is still another object to provide a furnace of the aforesaid nature having a simplified construction which reduces manufacturing cost and facilitates maintenance. These objects and other objects and advantages of the invention will be apparent from the following description.

SUMMARY OF THE INVENTION

The objects of the present invention are accomplished in general by providing a fireplace structure of substantially box-like outer configuration having a compartment for the combustion of a solid fuel, a compartment for the combustion of a fluid fuel, and a chamber surrounding said combustion compartments through which air can be circulated in a manner to absorb heat from either or both of said compartments. Each of said combustion compartments is constructed at least in part of a thermally conductive material such as iron, and is provided with an opening at the uppermost portion thereof for the escape of combustion fumes and means at a lower portion thereof for admission of adequate air to support combustion.

The compartment for solid fuel combustion preferably has an elongated configuration and is substantially centrally positioned within said furnace, extending between the front and rear faces thereof. The compartment for fluid fuel combustion substantially surrounds the front and side portions of the compartment for solid fuel combustion, and is fabricated as an integral unit that can be inserted through the front end of the furnace during the fabrication thereof.

Baffle means are disposed within the compartment for fluid fuel combustion and in the space between said compartments, said space being part of said air circulation chamber. The baffle means improve the uniformity of flow and efficiency of heat transfer within said compartment for fluid fuel combustion and within said air circulation chamber.

The air circulation chamber is provided with inlet and outlet openings which may connect with suitable conduits exterior to said furnace to facilitate the circulation of air through said chamber and thence to remote regions of the building housing the furnace. The outer boundry of said chamber is defined by the exterior, visually apparent walls of said furnace.

The front of the furnace is provided with a heat resistant transparent window which constitutes a major portion of the front face of the compartment for solid fuel combustion. The rear of the furnace is provided with upper closure means, preferably in the form of a hinged door, which constitutes a major portion of the rear face of the compartment for solid fuel combustion and permits extrance of solid fuel, and lower closure means which permits removal of ashes from said compartment.

BRIEF DESCRIPTION OF THE DRAWINGS

In the accompanying drawing forming a part of this specification and in which similar numerals of reference indicate corresponding parts in all the figures of the drawing.

DETAILED DESCRIPTION OF THE INVENTION

Figure 1:
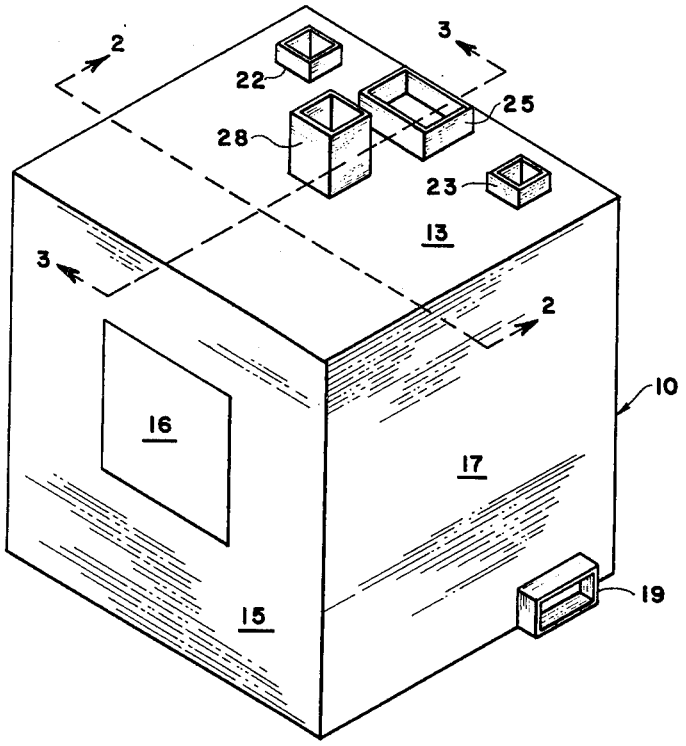
FIG. 1 is a perspective view showing the external features of an embodiment of the furnace of the present invention.
Figure 2:
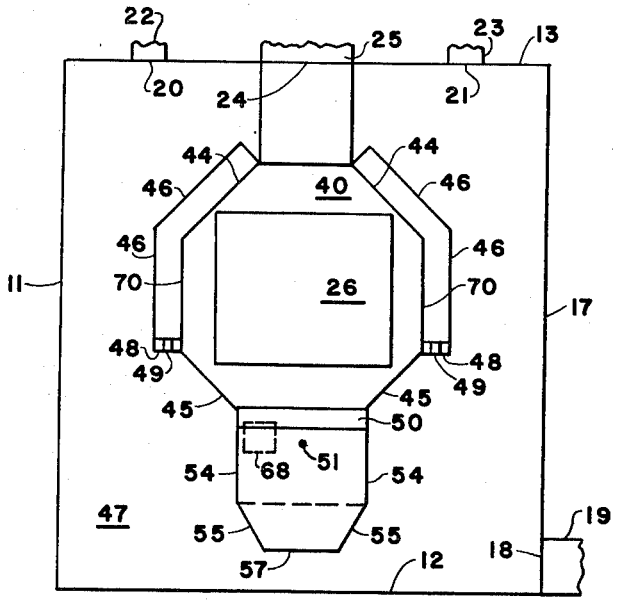
FIG. 2 is a vertical sectional view taken along the lines 2—2 of the furnace of FIG. 1 with the compartment for fluid fuel combustion removed therefrom for clarity of illustration.

Referring to FIGS. 1 and 2, a dual mode furnace 10 of the present invention is shown constructed throughout of heavy gauge iron plates interconnected by welding or removeable fastening means. The furnace has a substantially box-like outer envelope comprised of two vertical sidewalls 11 and 17, horizontal floor 12 and roof 13, vertical rear wall 14, and vertical front face 15 having window 16 centered on the vertical bisecting axis of said front face.

Figure 4:
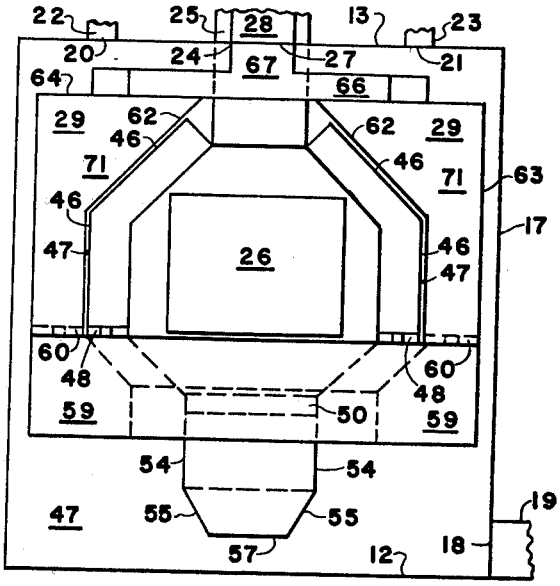
FIG. 4 is a front elevational view of the furnace of FIG. 1 with the front face removed therefrom.

Sidewall 17 is provided with an opening 18 adjacent floor 12 to facilitate attachment of conduit means 19 which admits air to said furnace to be heated and recirculated in a manner to be hereinafter described. Openings 20 and 21 are disposed in roof 13 adjacent sidewalls 11 and 17 respectively to facilitate attachment of conduit means 22 and 23 which conduct heated air out of the furnace for circulation to regions of a building other than the room containing the furnace. An opening 24 is located in roof 13 between openings 20 and 21 to facilitate attachment of first flue 25 for conducting combustion fumes out of compartment 26 which utilizes solid fuel. An opening 27, shown in FIG. 4, is positioned in roof 13 in front of opening 24 to facilitate attachment of second flue 28 for conducting combustion fumes out of compartment 29 which burns fluid fuel such as natural or producer gas, kerosine, heating oil, or the like. Flues 25 and 28 are directed into a conventional chimney, not shown, which conducts fumes away from the building. Adjustable vents, not shown, may be associated with said flues to control the volume of flow of fumes to the chimney.

Figure 3:
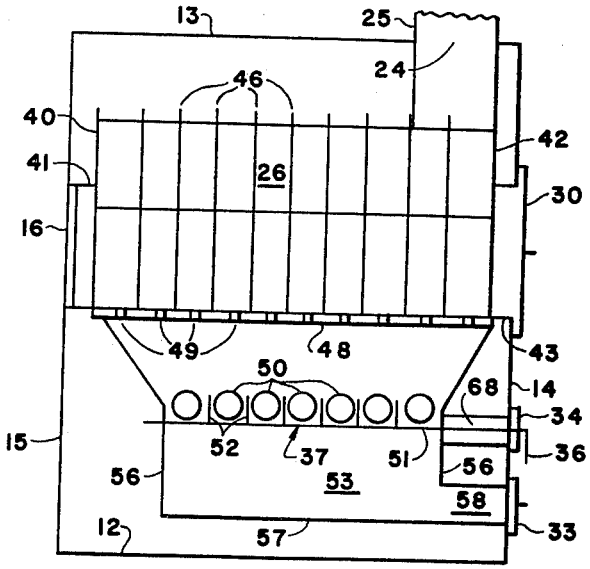
FIG. 3 is a vertical sectional view taken along the lines 3—3 of FIG. 1 with the compartment for fluid fuel combustion removed therefrom for clarity of illustration.
Figure 5:
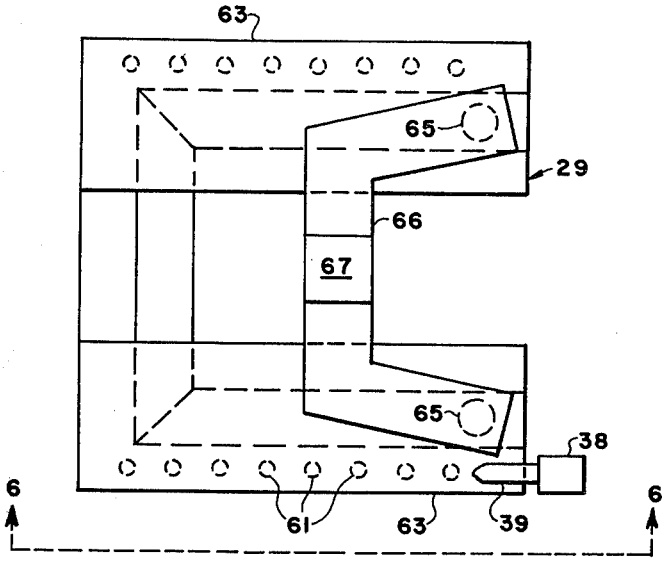
FIG. 5 is a plan view of a compartment for fluid fuel combustion, as would be incorporated within the furnace of FIG. 1.
Figure 6:
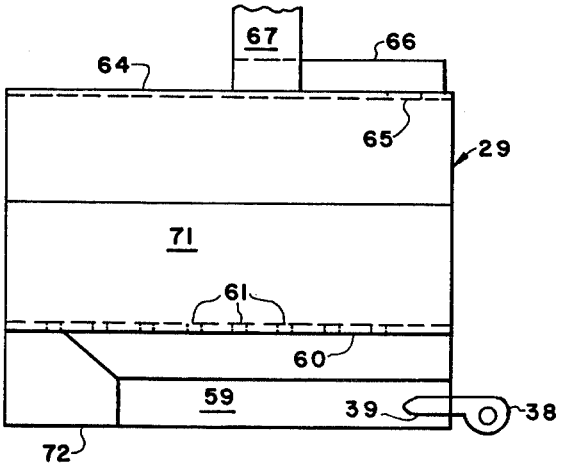
FIG. 6 is a side elevational view taken along the lines 6—6 of FIG. 5.
Figure 7:
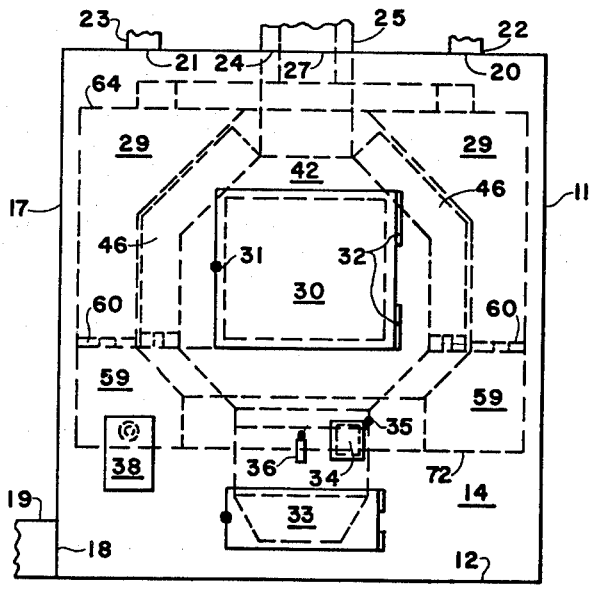
FIG. 7 is a rear elevational view of the furnace of FIG. 1.

The rear wall 14 is provided with upper closure means represented by hinged door 30, shown in FIG. 7, having a pull-knob 31 on one vertical side thereof, and hinges 32 on the opposite vertical side. Door 30 constitutes a portion of the rear boundary of compartment 26 and, when swung open, permits the addition of logs, coal or other solid fuel to compartment 26. Lower closure means represented by hinged door 33 mounted on rear wall 14 provides access to the bottom of compartment 26, whereby ashes may be removed therefrom. Damper plate 34 adjustably positionable about pivot 35 permits controlled admission of air through upper tunnel 68, shown in FIG. 3, to the lower region of compartment 26 to facilitate combustion therein. The handle 36 of log agitating means 37, shown in FIG. 3, protrudes from rear wall 14 from a location between the upper and lower closure means and generally adjacent damper plate 34. Means for admitting fluid fuel to compartment 29, repesented by oil delivery pump 38 and associated nozzle 39, as shown in further detail in FIGS. 5 and 6, are mounted adjacent the lower portion of rear wall 14. Said means for admitting fluid fuel may alternatively comprise means for controllably admitting a gas containing carbon monoxide, hydrogen, methane, propane or other combustible species, or kerosine, or still other known fluids generally used for heating purposes, and further provides a controlled air supply to effect adequate combustion.

The compartment for solid fuel 26 comprises an elongated interior which extends between front wall 15 and rear wall 14 of the furnace. The forward end of said compartment is comprised essentially of a flat vertical panel 40 having substantially centered therein front flange 41 which attaches to front wall 15, and is covered by thermally resistant transparent window 16 lying in said front wall. The rear end of said compartment is similarly comprised essentially of a flat vertical panel 42 having rear flange 43, aligned with opposed front flange 41, terminating by attachment to rear wall 14 and covered by upper closure means 30. Said front and rear flanges associated with compartment 26 serve the purposes of providing space for air circulation between the front and rear panels of said compartment and the associated front and rear walls of the furnace, and facilitating construction of the furnace.

The sides of compartment 26 are comprised of flat upper panels 44, middle panels 70, and lower panels 45 interconnected in a manner causing said compartment to have an octahedral cross section. The upper panels 44 and middle panels 70 may have attached thereto a series of parallel vanes 46 which conduct heat out of compartment 26 and effect efficient transfer of said heat to the air within air circulation chamber 47. A horizontally disposed baffle shoulder 48 containing a series of holes 49 is attached to compartment 26 below vanes 46 and is adapted to cause uniform flow of air within chamber 47 upwardly through the passageway between compartments 26 and 29.

A series of horizontal parallel grate tubes 50 is positioned adjacent the lower portion of compartment 26, said tubes being aligned parallel to the front wall of the furnace. Such alignment is particularly effective in supporting logs which are inserted lengthwise into compartment 26 through door 30. The hollow construction of the tubes effects transfer of heat to air in chamber 47 which passes through said tubes. Log agitating means 37, comprised of handle 36, longitudinal rod 51 and prongs 52 attached at right angles to said rod, is rotatively mounted below grate tubes 50 and adapted to permit prongs 52 to pass between said tubes for the purpose of positioning logs or clearing the spaces between the grate tubes.

An ash-collecting cavity 53 is positioned below grate tubes 50. The embodiment of said cavity illustrated in the drawings is defined by opposed vertical side plates 54, opposed angled side plates 55, opposed end plates 56 and bottom plate 57. Said ash-collecting cavity is adapted to gather into a confined area the ash formed from the burning of solid fuel. Lower horizontal tunnel 58 communicates between said ash-collecting cavity and lower closure means 33, thereby facilitating removal of ashes through the rear wall of the furnace. Since said rear wall is outside the building which contains the furnace, there is avoided the need to handle dusty ashes within the building.

The embodiment of compartment 29 for combustion of fluid fuel illustrated in the drawings, particularly in FIGS. 5 and 6, has a horizontally disposed combustion channel 59 which is disposed about the lower region of the front and both sides of compartment 26. The bottom of channel 59 is defined by c-shaped floor panel 72. The portions of channel 59 adjacent the sides of said compartment are enclosed from above by horizontally disposed baffle plates 60 having holes 61 therein to permit heated combustion gases to pass upwardly into opposed plenums 71. Said plenums are contoured on their interior sides 62 to generally conform with the contour of the sides of compartment 26. The space between said interior sides 62 and the sides of compartment 26 is occupied by vanes 46 and baffle plate 48 attached to said compartment in a manner to facilitate efficient passage of air to be heated, said space being part of air circulation chamber 47. The outer sides 63 of plenums 71 are spaced from the side walls of the furnace so as to permit passage of air therebetween as part of chamber 47. The tops of plenums 71 are closed by flat roofs 64 having exit openings 65 which communicate with horizontal conduit 66 and associated vertical duct 67 for the removal of gases through flue 28.

Compartment 29 is generally designed in a manner so as to fit in close conformity with compartment 26 and the four vertical walls of the outer envelope of the furnace, allowing adequate space for the controlled passage of air therebetween. Because of this construction, air is caused to pass in contact with the interior, outer, upper and lower surfaces of compartment 29 to achieve efficient heat transfer therefrom. Compartment 29 is substantially immersed within and surrounded by the air space comprising chamber 47. The integral construction of compartment 29 also facilitates construction of the furnace. In particular, said compartment may be inserted into the furnace before installation of front wall 15 of the furnace. Compartment 29 may be supported in place within the furnace by resting abutment upon vanes 46 affixed to the sides of compartment 26. Once compartment 29 is inserted into place, the vertical duct 67 meets with opening 27 in the roof 13 of the furnace, and flue 28 is attached to said duct. Means for admitting fluid fuel are then connected to combustion channel 59 through rear wall 14 of the furnace. In some embodiments, duct 67 may extend above roof 13 of the furnace, in which case an access slot is cut in said roof to facilitate insertion of compartment 29, and the access slot is subsequently closed with an overlapping plate.

The furnace of this invention is preferably enclosed by insulative brickwork, particularly at sides 11 and 17 of the outer envelope. Front face 15 and rear wall 14 may be partially covered by brickwork so as not to interfere with functional features. The furnace may be incorporated into a brick fireplace enclosure having a masonry foundation and chimney.

A temperature responsive thermostatic control unit may be positioned within chamber 47 closely adjacent an outer wall of compartment 26. Said control unit functions in a manner such that, when the temperature falls below a predetermined value, the fluid fuel burning system, which includes pump 38, is activated. Suitable manual overrides may be incorporated into the control unit so that, if no heat is desired from the furnace, or if it is desired to burn wood only, the fluid fuel system will not be activated. A fan which circulates air through chamber 47 and associated conduits may be either manually controlled or automatically controlled by said thermostatic control unit. The air which is forced through chamber 47 is preferably air which is recirculated within the building by means of ductwork communicating with said chamber.

While particular examples of the present invention have been shown and described, it is apparent that changes and modifications may be made herein without departing from the invention in its broadest aspects. The aim of the appended claims, therefore, is to cover all such changes and modifications as fall within the true spirit and scope of the invention.

Having thus described my invention, what is claimed is:

1. In a furnace comprising a first compartment for the combustion of a solid fuel, and having a grate for supporting said fuel during combustion, a second compartment for the combustion of a fluid fuel, a chamber through which air is circulated in a manner to absorb heat from the walls of said compartments, each of said compartments being constructed at least in part of a thermally conductive material and provided with openings for escape of combustion fumes and admission of air to support combustion, said furnace having a front wall adapted to face into a room into which heat is to be transferred from said furnace, and an opposing rear wall, the improvement comprising:

(a) a chamber of the aforesaid nature, the outer boundaries of which constitute the outer envelope of said furnace and comprise a box-like walled structure which substantially completely surrounds said first and second compartments, (b) a first compartment of the aforesaid nature having a door in the rear end thereof to permit entrance of solid fuel, means positioned below said grate for the collection of unburned ash from said solid fuel, and mens communicating with the rear wall of said furnace to facilitate removal of said ash, and (c) a second compartment of the aforesaid nature constructed to surround at least part of said first compartment at a sufficient spacing therefrom to permit air from said chamber to pass therebetween and having means communicating with the rear wall of said compartment for the entrance of fluid fuel.

2. The furnace of claim 1 wherein said chamber is provided with means adjacent the bottom of said furnace for the entrance of air and means adjacent the top of said furnace for the emergence of said air having been heated by contact with said first and second compartments.

3. The furnace of claim 2 wherein the outer walls of said first compartment contain vertically elongated vanes serving to enhance the conductive transfer of heat out of said first compartment.

4. The furnace of claim 3 wherein said second compartment is an integral structure removeable from said furnace and having an interior side wall which conforms to the contour of said vanes, and exterior side walls spaced apart from the outer envelope of said furnace.

5. The furnace of claim 4 wherein a horizontally disposed baffle means is positioned below said vanes to promote uniformity of flow of air upwardly through said chamber.

6. The furnace of claim 1 wherein said first compartment has a substantially octahedral perimeter in a plane parallel to the front of said furnace.

7. The furnace of claim 1 wherein said grate is comprised of a series of tubes in parallel alignment with the front wall of said furnace, said tubes communicating with said chamber in a manner to permit passage of air.

8. The furnace of claim 1 wherein the front end of said first compartment contains a transparent window positioned substantially in the front wall of said furnace.

9. The furnace of claim 1 wherein said second compartment is comprised of two oppoesd, substantially vertically disposed plenums having openings in the tops thereof through which fumes are conducted to a single flue.

* * * * *